US010222752B2

(12) United States Patent
Leigh-Bramwell et al.

(10) Patent No.: US 10,222,752 B2
(45) Date of Patent: Mar. 5, 2019

(54) TIDAL CLOCK

(71) Applicant: Bramwell Brown Limited, London (GB)

(72) Inventors: Rob Leigh-Bramwell, London (GB); Sarah Leigh-Bramwell, London (GB)

(73) Assignee: Bramwell Brown Limited, London (GB)

( * ) Notice: Subject to any disclaimer, the term of this patent is extended or adjusted under 35 U.S.C. 154(b) by 61 days.

(21) Appl. No.: 15/319,696

(22) PCT Filed: Jul. 28, 2015

(86) PCT No.: PCT/GB2015/052180

§ 371 (c)(1),
(2) Date: Dec. 16, 2016

(87) PCT Pub. No.: WO2016/016637

PCT Pub. Date: Feb. 4, 2016

(65) Prior Publication Data

US 2018/0210398 A1 Jul. 26, 2018

(30) Foreign Application Priority Data

Jul. 28, 2014 (GB) ..... 1413321.9

(51) Int. Cl.

| | |
|---|---|
| ***G04B 19/26*** | (2006.01) |
| ***G04B 47/06*** | (2006.01) |
| ***G04B 45/00*** | (2006.01) |

(52) U.S. Cl.

CPC ..... *G04B 19/266* (2013.01); *G04B 19/26* (2013.01); *G04B 45/0023* (2013.01); *G04B 47/06* (2013.01); *G04B 47/063* (2013.01)

(58) Field of Classification Search

CPC .. G04B 19/26; G04B 19/266; G04B 45/0023; G04B 47/06; G04B 47/063

See application file for complete search history.

(56) References Cited

U.S. PATENT DOCUMENTS 4,623,259 A 11/1986 Oberst
4,849,949 A * 7/1989 Voth ..... G04B 19/266 368/19

(Continued)

FOREIGN PATENT DOCUMENTS

| | | |
|---|---|---|
| EP | 1 729 186 | 12/2006 |
| WO | WO 90/10259 | 9/1990 |
| WO | WO 2004/013708 | 2/2004 |

OTHER PUBLICATIONS

International Search Report dated Feb. 10, 2015 from International Application No. PCT/GB2015/052180.

(Continued)

*Primary Examiner* — Daniel P Wicklund
(74) *Attorney, Agent, or Firm* — B eyer Law Group LLP

(57) ABSTRACT

A tidal clock includes a clock face, a clock mechanism, a tidal display mechanism, a tidal drive arrangement and one or more symbolic display members. The tidal display mechanism includes a background and a plurality of laminar members overlying the background. Each laminar member includes a display representing sea and having an upper edge configured to represent a sea level. The laminar members are independently movable between respective lower and upper positions to represent rise and fall of the sea level. The symbolic display members are each mounted on a respective support. Each support is engaged with the background, permitting movement between lower and upper positions, further engaging a respective laminar member and arranged so that the support and display mounted thereon is urged to move between lower and upper positions by the corresponding movement of the laminar member.

16 Claims, 8 Drawing Sheets

(56) References Cited

U.S. PATENT DOCUMENTS

| | | | | | |
|---|---|---|---|---|---|
| 5,111,439 | A * | 5/1992 | Erard | G04B 19/266 | 368/19 |
| 5,270,986 | A | 12/1993 | Kerr | | |
| 5,579,289 | A * | 11/1996 | Kerr | G04B 19/266 | 368/19 |
| D786,727 | S * | 5/2017 | Leigh-Bramwell | D10/103 | |
| D786,729 | S * | 5/2017 | Leigh-Bramwell | D10/103 | |
| 2014/0104991 | A1* | 4/2014 | Rochat | G04F 7/0866 | 368/11 |
| 2015/0168438 | A1* | 6/2015 | Tsubata | G01P 3/62 | 702/144 |
| 2017/0038735 | A1* | 2/2017 | Leigh-Bramwell | G04B 47/066 | |

OTHER PUBLICATIONS

Written Opinion dated Feb. 10, 2015 from International Application No. PCT/GB2015/052180.

* cited by examiner

TIDAL CLOCK

This invention relates to a tidal clock of the kind which combines the functions of a tidal display and clock into an integral device.

A tidal display may provide a visual indication of the state of a sea tide, for example, to show high tide and low tide. Generally a tidal display is provided as a stand-alone device, not incorporating a clock. A tidal display and clock may be mounted side by side in a wooden case so that the two mechanisms operate entirely separately but can be viewed simultaneously.

A previously known tidal clock comprises a dial with a hand which points to a circular display showing the hours to high tide and low tide. A small, moving laminar display, representative of sea level is located above from and separate to the dial. The mechanism is driven by a tidal clock motor. Such a motor is accurate but does not generate sufficient power to actuate anything other than a small simple display. Furthermore a display comprising multiple components or sufficiently large to be integral with a clock face cannot be accurately driven by such a drive unit.

According to the present invention, a tidal clock comprises a clock face and a clock mechanism comprising a spindle located in the face and driven by the mechanism and rotatable hands mounted on the spindle to provide a time display;

the tidal display mechanism comprising a background, a plurality of laminar members overlying the background, each including a display representing sea and having an upper edge configured to represent a sea level;

wherein each member is independently movable between respective lower and upper positions to represent rise and fall of sea level;

a plurality of symbolic display members each mounted on a respective support, each support being engaged with the background, permitting movement between lower and upper positions, further engaging a respective laminar member and arranged so that the support and display mounted thereon is urged to move between lower and upper positions by the corresponding movement of the laminar member;

a tidal drive arrangement comprising a drive mechanism and a drive shaft having a plurality of eccentric cams, each cam engaging a follower connected to a respective laminar member so that rotation of the drive shaft causes movement of the laminar members between the lower and upper positions;

wherein the tidal drive arrangement includes an actuator and a sensor, one of the actuator and sensor being engaged to rotate with the drive shaft and the other of the actuator and sensor being at a fixed location, arranged so that the actuator engages the sensor to generate a signal at a predetermined angular orientation of the drive shaft;

the drive mechanism comprising a controller, motor and power supply;

the controller being arranged to control the motor to regulate rotation of the drive shaft and responsive to said signal to reset the drive shaft to the predetermined orientation.

Use of a tidal clock in accordance with the present invention confers several advantages. A more powerful but less accurate motor may be employed. A tidal display having larger or more numerous components which may be heavier and have a greater frictional resistance can be driven without loss of accuracy. The present invention also allows a larger display to be provided, so that the tidal clock may be integral with a wall clock or other clock having a relatively large face. The present invention allows the tidal display to be integral with a tidal clock face and visible from a reasonable distance. For example, a display having a diameter of 50 cm or greater may be provided. Also a display having three or more tidal dials may be employed. Typically the tidal dials may show the number of hours to high tide, the number of hours to low tide and the actual tidal position as separate displays.

Advantageously the motor may be connected to the tidal drive arrangement by a pulley or gear linkage in order to increase the torque delivered to the drive shaft by the drive mechanism without greatly increasing power consumption of the motor. The linkage may conveniently comprise a pulley arrangement having a drive belt or chain. In an exemplary embodiment the drive may be stepped up from 20 teeth to 72 teeth.

In a preferred embodiment a stepper motor is employed. A stepper motor may have a higher torque rating and more efficient power consumption than a conventional tidal drive. A stepper motor may be used to lift two or more laminar members and two or more symbolic display members.

The controller may be arranged to turn on the stepper motor periodically, for example, every 30 minutes, to update the orientation of the display, and further arranged so that the motor is turned off between updates.

The sensor may comprise a switch arranged to be engaged by the actuator to send a signal to the controller. The actuator is preferably engaged to or integral with the drive shaft so that the switch is actuated at a predetermined point of each revolution of the drive shaft, for example at the high tide orientation.

Use of a sensor ensures that the tidal clock is self-calibrating. The accuracy of the display is updated and corrected as necessary during each cycle, to overcome any errors due to frictional losses in the drive mechanism, or inherent inaccuracies of the motor. Therefore a more powerful but less precise motor may be employed.

The stages of operation of a particularly advantageous embodiment of the invention are as follows:

1. Setting the Tide Position Stage:
1. User turns the unit on.
2. User presses a 'set' button which cycles the motor and therefore the tide position dial, to set the current tide position in accordance with official tide charts. The tide timetables for any particular location are available on meteorological websites.
2. System Calibration Stage:
1. The program cycles the motor by 60 steps (0.5 degrees/step=30 degrees) every 31 m 2 s. Visually this results in a 1/24 movement of the 12 hour dial.
2. The motor torque is stepped up through a 20/72 teeth pulley and belt system.
3. The result is a 15 degree movement of the drive shaft.
4. The program continues with this program repeatedly until the actuator engages the sensor to cause the sensor to send a signal to the controller.
5. When the signal is received the controller identifies that point as a set position (e.g. high tide) to which the display needs to return at the end of each tide cycle.
3. Normal Operation:

The program will aim to be complete in 24 cycles of 60 steps every 31 m 2 s. One full cycle is completed in 12 h 25 m.

In most locations, the largest constituent is the "principal lunar semi-diurnal", also known as the M2 (or $M_2$) tidal constituent. The period is about 12 hours and 25.2 minutes, exactly half a tidal lunar day. This is the average time separating one lunar zenith from the next.

1. The controller cycles the motors by 60 steps (0.5 degrees/step=30 degrees) every 31 m 2 s—for 23 counts.
2. On the $24^{th}$ cycle the controller cycles the motor indefinitely until the sensor and actuator are engaged and the mechanism has returned to its starting position (e.g. high tide).
3. This ensures that the visual tide cycle and dial display remains accurate consistent with the official tide charts.

During the 23 cycles it is likely that the mechanism will have lost a small amount of distance. Therefore if the final $24^{th}$ movement is kept constant at 60 steps, the mechanism will not have returned high tide at the correct time.

Over the course of several tide cycles this may cause inaccuracy and require regular re-calibration by the user.

The above described program eliminates this inaccuracy and ensures the user need only set the clock with tide charts once on initial start-up.

The controller arranged to control the motor to regulate rotation of the drive shaft and responsive to a said signal to reset the display to a predetermined configuration.

The clock spindle and tidal drive shaft may be concentric. Alternatively, the tidal drive shaft may be radially offset from the axis of the clock face. Preferably the clock drive spindle extends axially of the tidal display.

Each eccentric cam is preferably circular with the centre of rotation being displaced from the centre of the cam, in the manner of an eccentric sheave. Use of an eccentric cam produces a smooth wave motion of the laminar member to represent tidal rise and fall of the sea level.

Each cam is preferably displaced angularly relative to the other cam or cams.

The symbolic display members preferably represent floating objects such as boats or buoys. The members therefore depict raising and lowering of the boats as the sea level rises and falls.

The support may pass through a slot in the display, being member constrained to follow the direction of the slot as the display member rises and falls.

The support may also include an aperture to receive the clock spindle and tidal display drive shaft.

There are preferably three or four laminar members, most preferably three. The members are preferably located in parallel spaced relation between the background and rear of the clock face.

There are preferably three or four display members, each having a support resting on the upper surface of the laminar members. In this way, each boat or other display member rises and falls as the sea level, represented by the upper edge of the laminar member, rises and falls.

The upper edge of the forwardmost laminar member is preferably lower than the edges of the or each rearward laminar members so that each of the edges can be seen in use.

The rearward edge preferably rises first as the tide rises, followed by an adjacent edge and followed in turn by the forwardmost edge closest to the clock face.

The clock face may further comprise an annular ring rotatable to provide an indication of the state of the tide. For example, words or symbols depicting high tide, tide flooding, low tide or tide ebbing may be provided. The annular ring may be driven by an orbital gear arrangement connected to the tidal drive arrangement.

The laminar members may have vertically extending formations on each side, for example, flanges mounted in slots in the clock casing to permit vertical sliding movement as the eccentric cams rotate. Each laminar member preferably has a downwardly facing cam follower arranged to engage a respective eccentric cam.

The drive mechanism is preferably arranged to provide a movable display having a cycle of 26 hours. When technically describing tides a cycle is normally measured from High to High. This mechanism of this invention works on a principal lunar semi-diurnal also known as the M2 (or $M_2$) tidal constituent. Its period is about 12 hours and 25.2 minutes, exactly half a tidal lunar day, which is the average time separating one lunar zenith from the next, and thus is the time required for the Earth to rotate once relative to the Moon. Due to other influences the actual time between High and High changes between 12 and 13 hours.

For simplicity tidal clocks typically run on a 12 hour cycle (High-High) count 6 hours between each high and low condition.

Over the course of a month they become inaccurate by approximately 15 minutes and need re-setting.

The clock face preferably includes an aperture, the background, laminar members and display members being visible through the aperture. In a preferred embodiment, the aperture may be located in an upper part of the clock face.

One or more dials may be provided in a lower part of the clock face to represent phases of the moon or other features relating to tidal motion.

This invention provides several advantages. An integral display of the time and tidal conditions is provided in an efficient and attractive arrangement. The drive mechanism provides an efficient and accurate means for controlling the tidal display.

The invention is further described by means of example, but not in any limitative sense, with reference to the accompanying drawings, of which:

Figure 1:
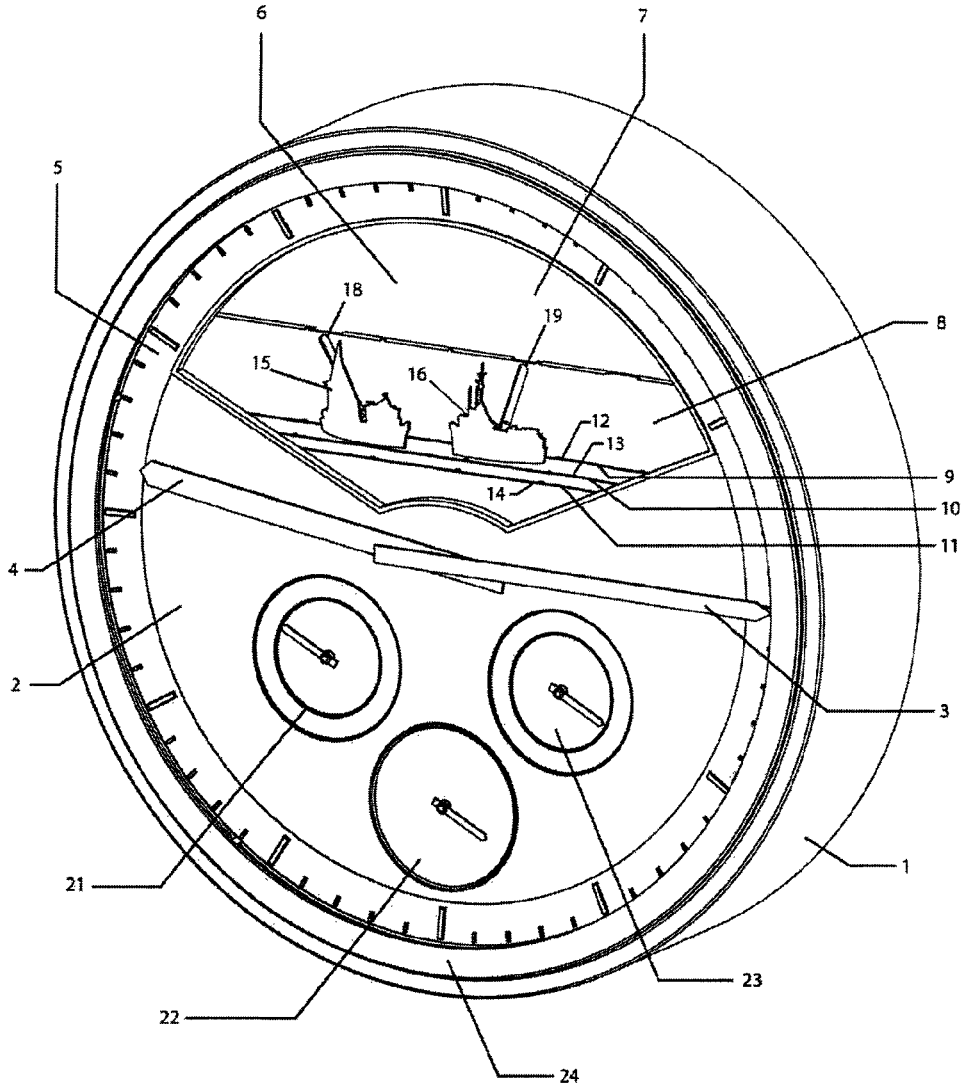
FIG. 1 is a perspective view of a tidal clock in accordance with this invention.

The tidal clock shown in FIGS. 1 to 8 comprises a casing (1), a clock face (2) and clock hands (3,4). The time is shown by an annular hours and minutes display (5). An aperture (6) in the clock face (2) allows the tidal display to be observed. The display comprises a skyline (7) and a foreground display (8) representing a town or other feature. Three laminar members (9,10,11) represent background, middleground and foreground waves and have upper edges (12,13, 14) to represent sea levels.

Display members (15,16) may represent boats floating in the sea. The boats are constrained to move upwardly and downwardly in slots (18,19) in the background member (8) as described below.

Dials (21,22,23) in a lower part of the clock face represent phases of the moon, the state of the tide (whether rising or falling) and the height of the tide.

Figure 2:
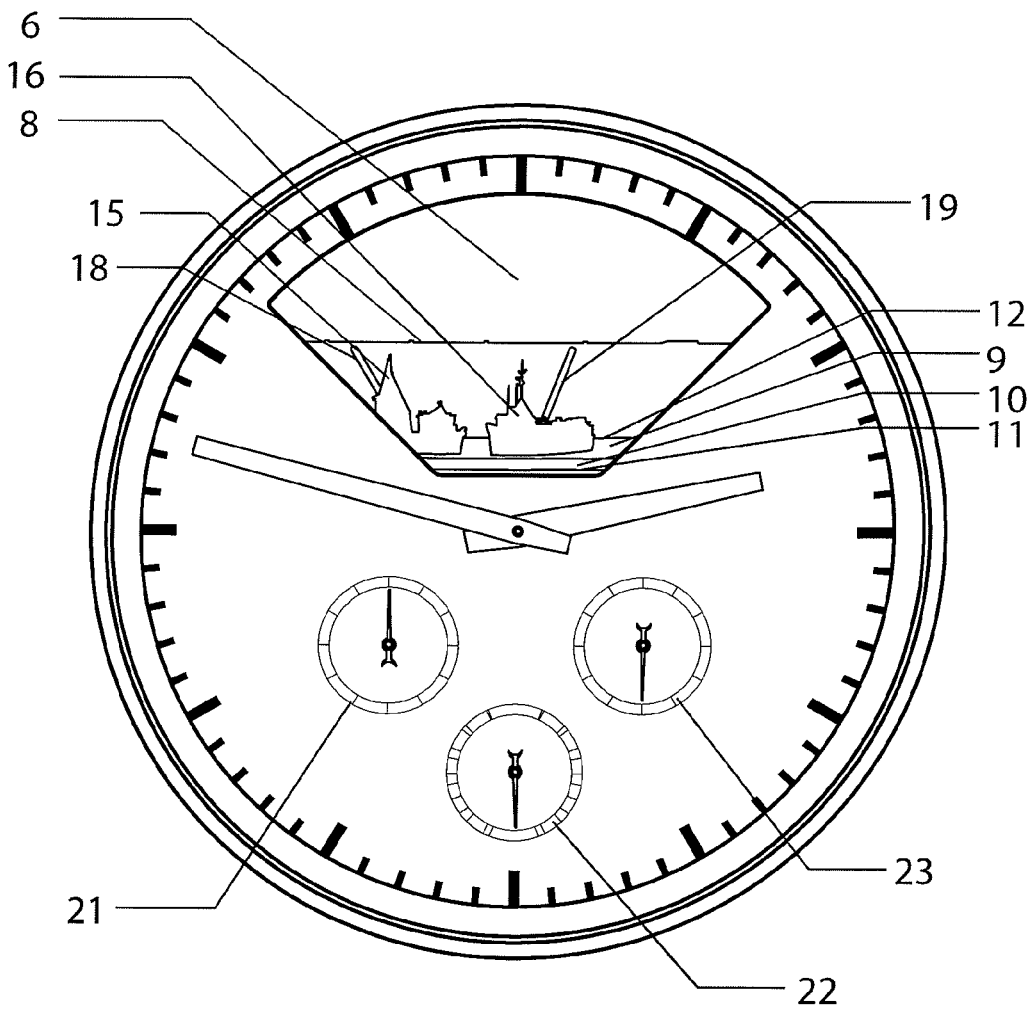
FIGS. 2 to 5 show successive stages of movement of the display.

FIGS. 2 to 5 show successive stages in movement of the tidal display. In FIG. 2 a low tide display is shown. The laminar members (9,10,11) are at the lowermost part of the aperture (6). The boat displays (15,16), resting on the upper edge (12) of the laminar member (9), rest at the lower ends of the slots (18,19) in the background member (8).

Figure 3:
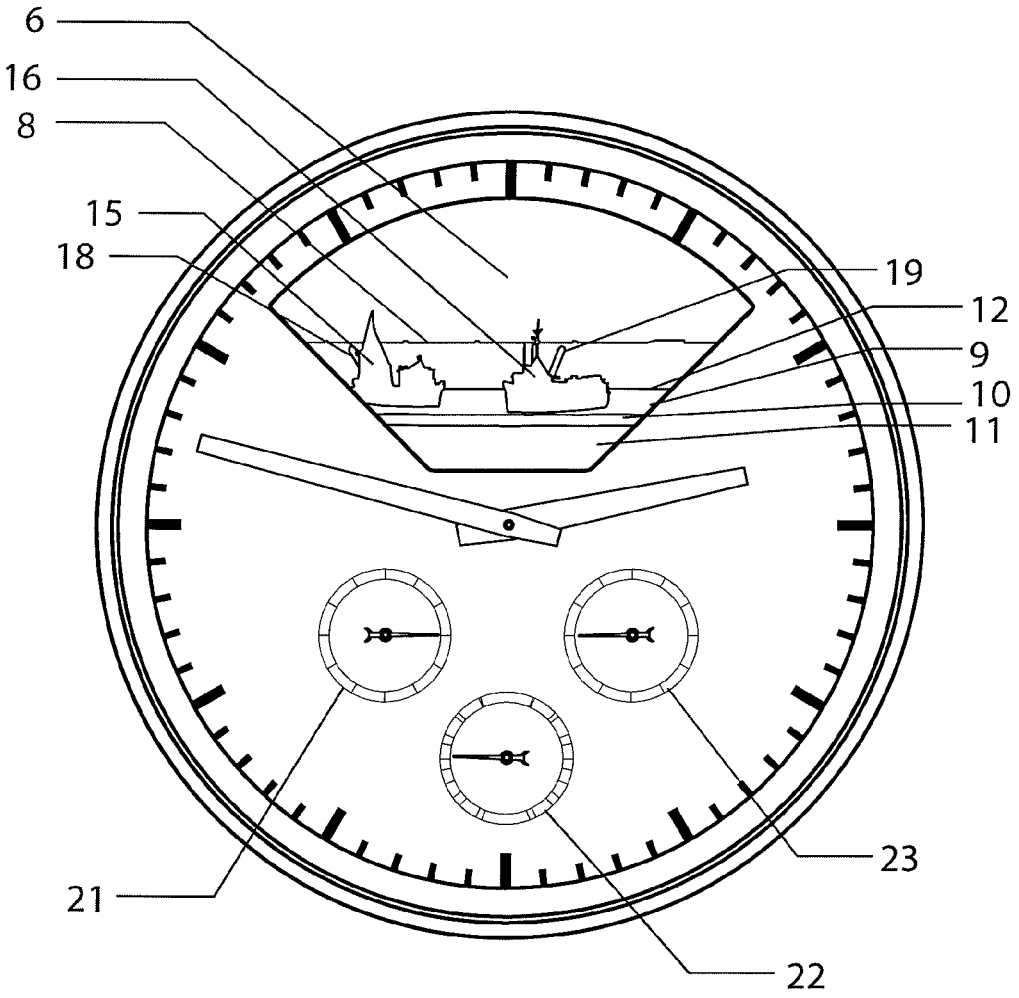

In FIG. 3 the tide has started to rise so that the laminar members (9,10,11) are raised from the lower position, resulting in corresponding raising of the boats (15,16) within their respective slots. The dials (21,22,23) show the corresponding phases of the Tide. Dial (21) contains 12 hour markers and indicates the time remaining to next low tide. Dial (23) contains 12 hour markers and indicates time remaining to next high tide. Dial (22) indicates the current condition of the tide as either High, Ebbing, Low or Flooding. In FIG. 3 Dial (21) shows 9 hours until next low tide. Dial (23) shows 3 hours until next high tide and dial (22) shows the tide condition as flooding.

Figure 4:
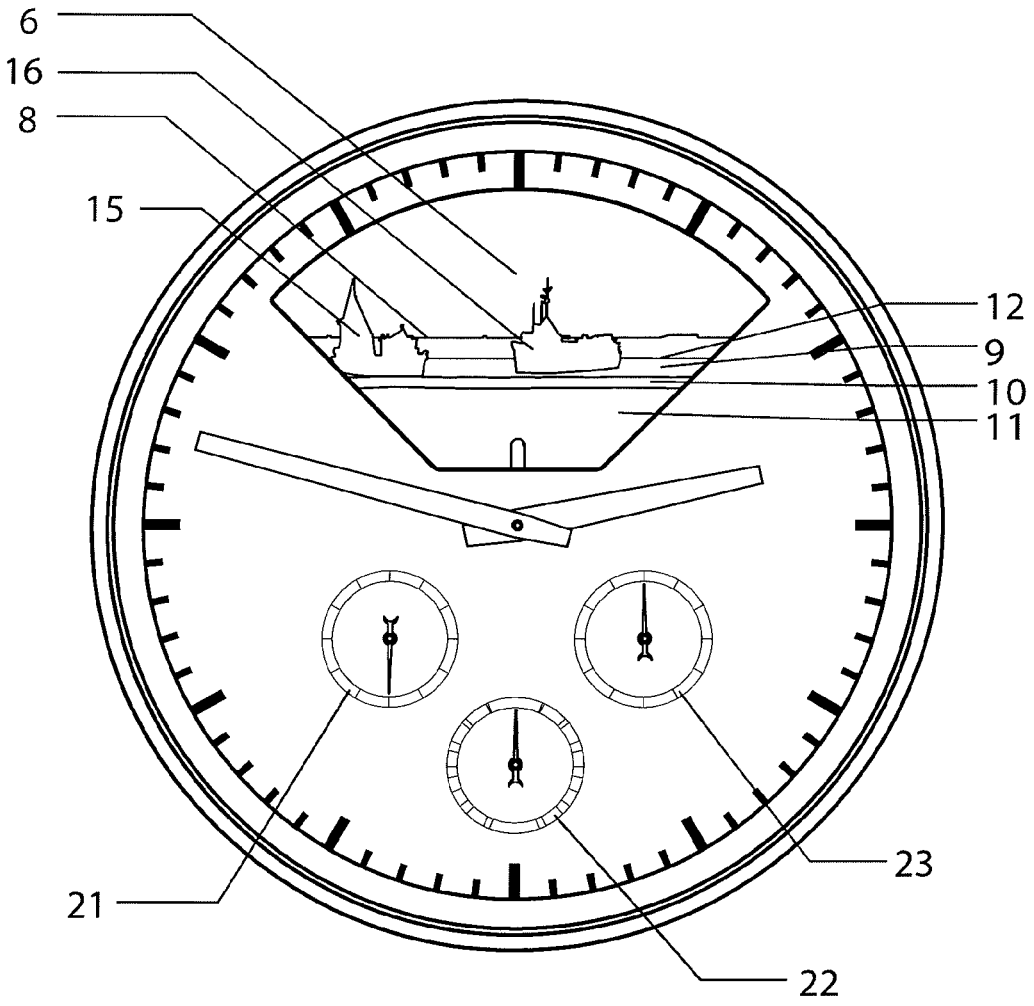

In FIG. 4 the high tide position has been reached so that the boats (15,16) are at the uppermost positions within their respective slots (18,19). Dial (21) shows 6 hours until next low tide. Dial (23) shows high tide (or 0 hours until high tide), and dial (22) additionally shows the current tide condition as high tide.

Figure 5:
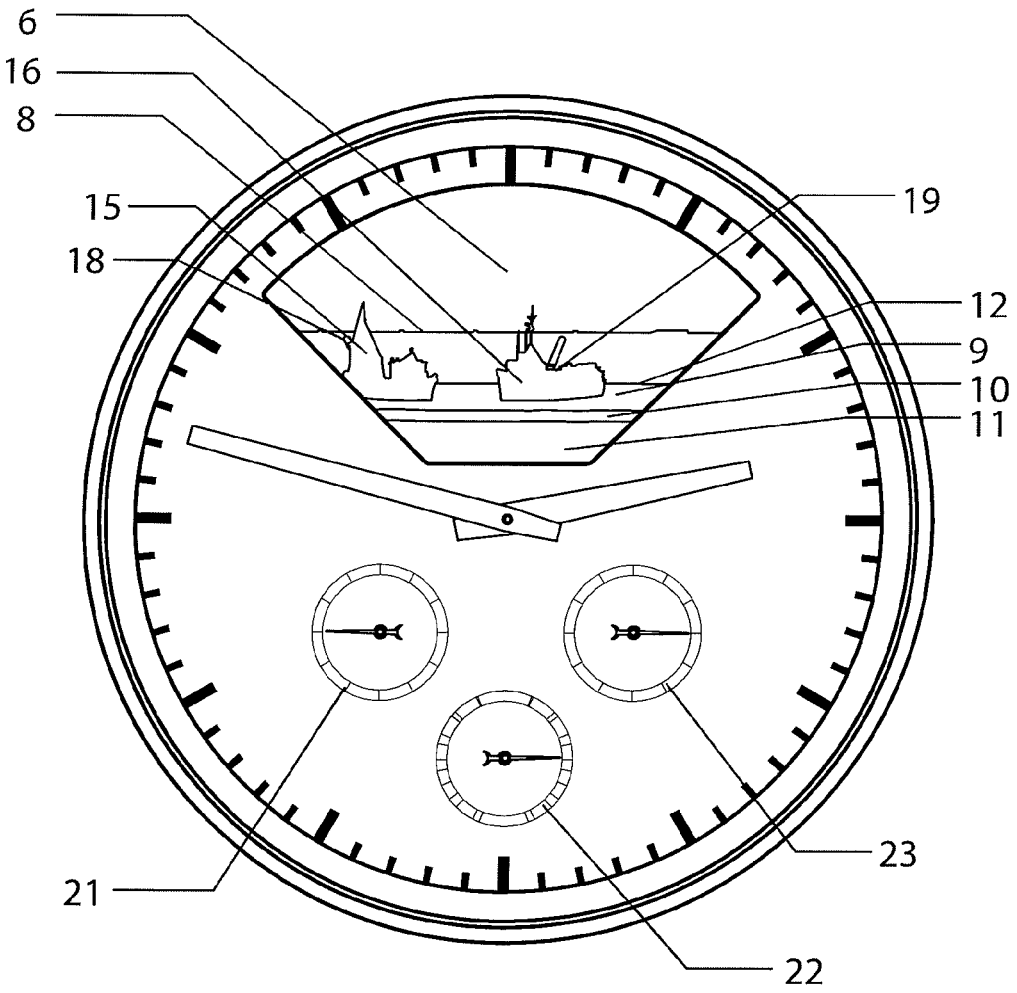

FIG. 5 shows the display as the tide is falling. The upper edges of the laminar members are falling towards the lower position and the boats (15,16) are falling within their respective slots to return to the position shown in FIG. 2.

Figure 6:
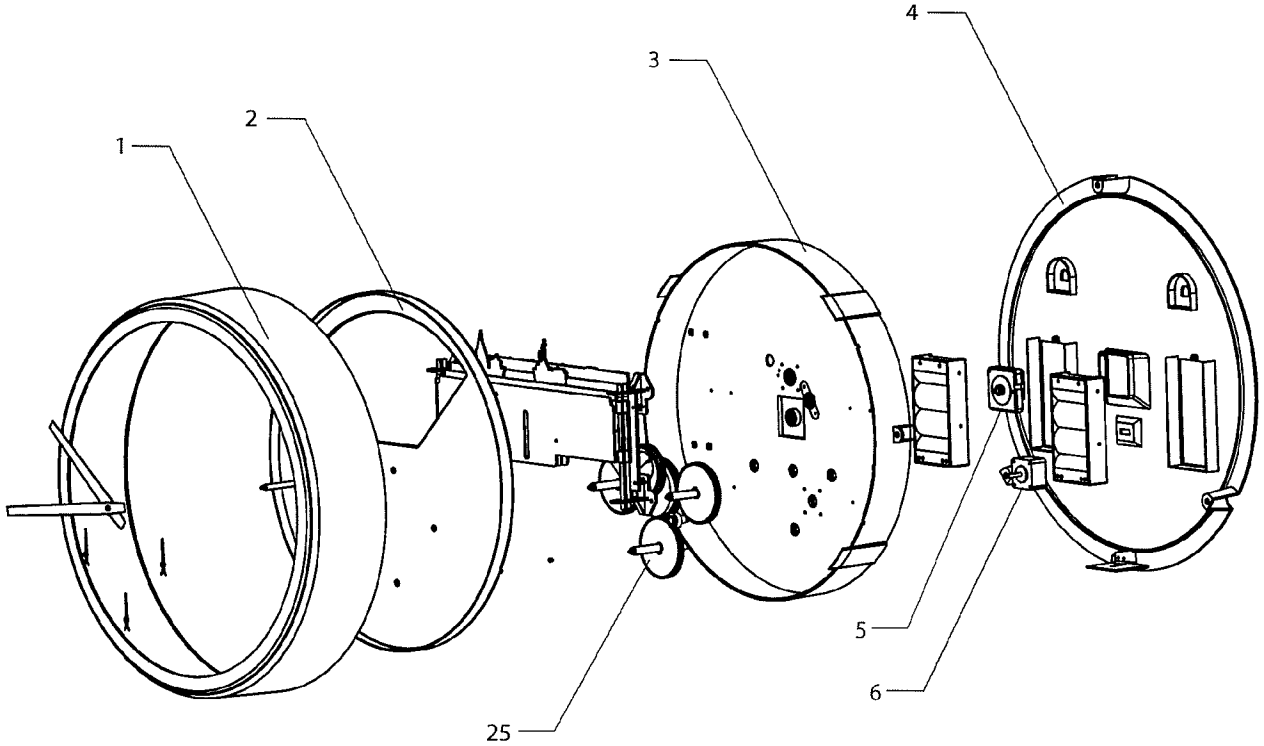
FIG. 6 is an exploded view of the tidal display mechanism.
Figure 7:
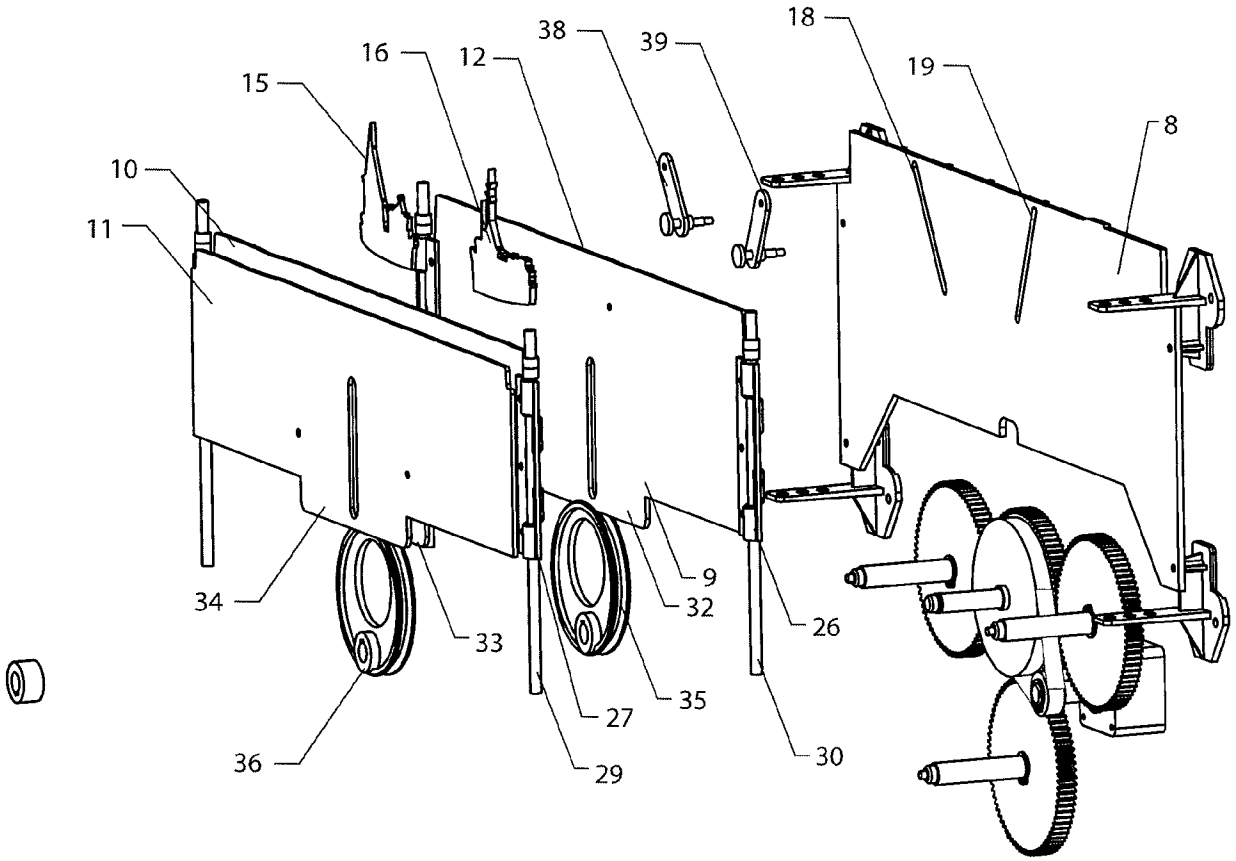
FIG. 7 shows the moving parts of the tidal display mechanism.
Figure 8:
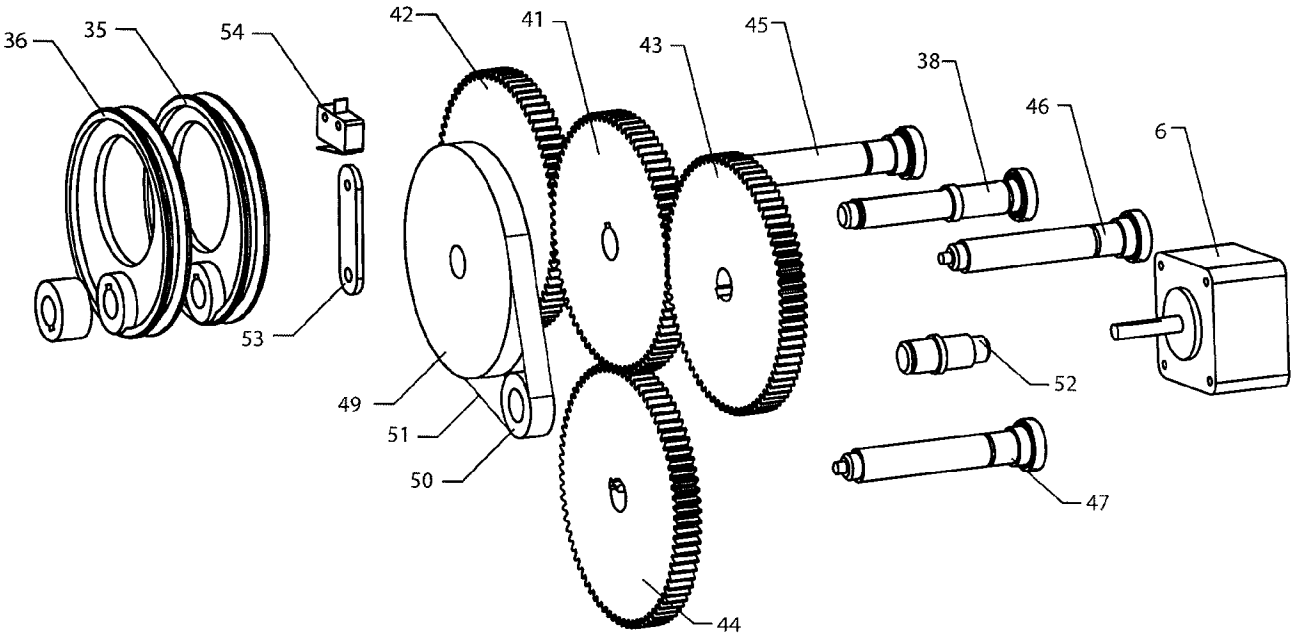
FIG. 8 shows the gear arrangement of the tidal display mechanism.

FIGS. 6 to 8 show the internal features of the tidal clock. The casing (1) receives the clock face (2) and a rear casing member (3) with a closure (4). A clock drive motor (5) and tidal drive motor (6) are mounted on the rear casing (3).

A gear mechanism (25) connected to the tidal display drives the three dials (21,22,23) and the cams.

The movable parts of the tidal display are shown in FIG. 7. The laminar members (9,10,11) are held captive in end pieces (26,27,28) and are constrained to move vertically along bars or other elongate members (29,30). Each laminar member has downwardly extending cam follower (32,33,34) urged by gravitational force into contact with circular eccentric cams (35,36) respectively. The cams are mounted in a common drive shaft (38—see FIG. 8) so that the three cams rotate simultaneously. During rotation of the cams, the rearmost laminar member (9) is raised first, followed by the intermediate member (10), followed by the outermost member (11).

Two display members (15,16) representing boats are mounted on supports (38,39) located within the slots (18,19) in the background member (8). The supports (38,39) rest on upper edge (12) of the laminar member (9). In this way, the movement of the boats is made more variable by the configuration of the edges (12).

The drive arrangement of the tidal mechanism is shown in FIG. 8. A central shaft (38) connected to the drive motor (6) and drive shaft (54) through pulley and belt arrangement (49, 50, 51) has a sun gear (41). Orbital gears (42,43,44) are connected by shafts (45,46,47) to the dials (21,22,23) respectively. A mounting frame (48) supports the shafts.

FIG. 8 further shows the tide position calibration sensor comprising A switch arm (53) mounted on central shaft (38) and arranged to engage actuator (54) when the position of the system results in a high tide display.

In use of the tidal clock, the following steps are carried out:

1. Setting the Tide Position Stage:
1. User turns the unit on.
2. User presses a 'set' button which cycles the motor and therefore the tide position dial, to set the current tide position in accordance with official tide charts. The tide timetables for any particular location are available on meteorological websites.

2. System Calibration Stage:
1. The program cycles the motor by 60 steps (0.5 degrees/step=30 degrees) every 31 m 2 s. Visually this results in a 1/24 movement of the 12 hour dial.
2. The motor torque is stepped up through a 20/72 teeth pulley and belt system.
3. The result is a 15 degree movement of the drive shaft.
4. The program continues with this program repeatedly until the actuator engages the sensor to cause the sensor to send a signal to the controller.
5. When the signal is received the controller identifies that point as a set position (e.g. high tide) to which the display needs to return at the end of each tide cycle.

3. Normal Operation:

The program will aim to be complete in 24 cycles of 60 steps every 31 m 2 s. One full cycle is completed in 12 h 25 m.

In most locations, the largest constituent is the "principal lunar semi-diurnal", also known as the M2 (or $M_2$) tidal constituent. The period is about 12 hours and 25.2 minutes, exactly half a tidal lunar day. This is the average time separating one lunar zenith from the next.

1. The controller cycles the motors by 60 steps (0.5 degrees/step=30 degrees) every 31 m 2 s—for 23 counts.
2. On the $24^{th}$ cycle the controller cycles the motor indefinitely until the sensor and actuator are engaged and the mechanism has returned to its starting position (e.g. high tide).
3. This ensures that the visual tide cycle and dial display remains accurate consistent with the official tide charts.

The invention claimed is:

1. A tidal clock comprising a clock face and a clock mechanism comprising a spindle located in the face and driven by the clock mechanism and rotatable hands mounted on the spindle to provide a time display;

the tidal display mechanism comprising a background, a plurality of laminar members overlying the background, each of the plurality of laminar members representing sea and having an upper edge configured to represent a sea level;

wherein each laminar member is independently movable between respective lower and upper positions of such laminar member to represent rise and fall of the sea level;

a plurality of symbolic display members each mounted on a respective support, each support being engaged with the background, permitting movement between lower and upper positions of such support, further engaging a respective laminar member and arranged so that the support and display member mounted thereon is urged to move between the lower and upper positions of the support by the corresponding movement of the laminar member;

a tidal drive arrangement comprising a drive mechanism and a drive shaft having a plurality of eccentric cams, each eccentric cam engaging a follower connected to a respective laminar member so that rotation of the drive shaft causes movement of the laminar members between the lower and upper positions of the respective laminar members;

wherein the tidal drive arrangement includes an actuator and a sensor, one of the actuator and sensor being engaged to rotate with the drive shaft and the other of the actuator and sensor being at a fixed location, arranged so that the actuator engages the sensor to generate a signal at a predetermined angular orientation of the drive shaft;

the drive mechanism comprising a controller, motor and power supply;

the controller being arranged to control the motor to regulate rotation of the drive shaft and responsive to said signal to reset the drive shaft to the predetermined angular orientation.

2. The tidal clock as claimed in claim 1, wherein the motor is connected to the tidal drive arrangement by a pulley or gear linkage.

3. The tidal clock as claimed in claim 1, wherein the motor is a stepper motor.

4. The tidal clock as claimed in claim 3, wherein the controller is arranged to turn on the stepper motor periodically to update orientation of the display and further arranged to turn the motor off between updates.

5. The tidal clock as claimed in claim 1, wherein the sensor comprises a switch engaged by the actuator to send a signal to the controller.

6. The tidal clock as claimed in claim 5, wherein the actuator is engaged to or integral with the drive shaft so that the switch is actuated at a predetermined point of each revolution of the drive shaft.

7. The tidal clock as claimed in claim 6, wherein the switch is actuated at a high tide orientation.

8. The tidal clock as claimed in claim 1, wherein the tidal display mechanism is updated during each tidal cycle.

9. The tidal clock as claimed in claim 1, wherein the eccentric cams are circular.

10. The tidal clock as claimed in claim 1, wherein the eccentric cams are displaced angularly.

11. The tidal clock as claimed in claim 1, wherein the symbolic display members represent floating objects.

12. The tidal clock as claimed in claim 1, wherein each of the supports extends through a corresponding slot in the display.

13. The tidal clock as claimed in claim 1, comprising three or four laminar members located in parallel spaced relation between the background and the rear of the clock face.

14. The tidal clock as claimed in claim 1, wherein the upper edge of the forwardmost laminar member is lower than the edges of the other laminar members.

15. The tidal clock as claimed in claim 1, wherein the laminar members have vertically extending formations on each side to permit vertical sliding movement as the cams rotate in use.

16. The tidal clock as claimed in claim 1, wherein the follower of each laminar member is downwardly facing.

* * * * *